US005154741A

United States Patent [19]

da Costa Filho

[11] Patent Number: 5,154,741

[45] Date of Patent: Oct. 13, 1992

[54] DEEP-WATER OIL AND GAS PRODUCTION AND TRANSPORTATION SYSTEM

[75] Inventor: Fernando H. da Costa Filho, Rio de Janeiro, Brazil

[73] Assignee: Petroleo Brasileiro S.A. - Petrobras, Rio de Janeiro, Brazil

[21] Appl. No.: 730,136

[22] Filed: Jul. 15, 1991

[30] Foreign Application Priority Data

Jul. 13, 1990 [BR] Brazil ..... 9003370

[51] Int. Cl.[5] ..... B01D 49/00

[52] U.S. Cl. ..... 55/219; 55/268; 55/385.1; 166/357; 415/24

[58] Field of Search ..... 55/164, 182, 185, 210, 55/218, 219, 268, 269, 385.1; 166/357; 415/24

[56] References Cited

U.S. PATENT DOCUMENTS

| | | | |
|---|---|---|---|
| 933,976 | 9/1909 | Gray | 55/219 |
| 2,507,273 | 5/1950 | Schultz | 55/219 |
| 4,730,634 | 3/1988 | Russell | 55/164 |

*Primary Examiner*—Bernard Nozick
*Attorney, Agent, or Firm*—Sughrue, Mion, Zinn Macpeak & Seas

[57] ABSTRACT

A deep-water oil and gas production and transportation system including a wet Christmas tree, a 2-phase oil/gas vertical separator, a gas cooler, a vertical tubular scrubber and a motor-pump, and a platform which includes a velocity variator for the motor-pump, a pressure-relief valve for simultaneous control of a gas pipeline, the scrubber and the 2-phase separator, and, a programmable logical controller.

10 Claims, 6 Drawing Sheets

DEEP-WATER OIL AND GAS PRODUCTION AND TRANSPORTATION SYSTEM

FIELD OF THE INVENTION

The present invention relates to a production and transportation system for hydrocarbons such as oil and gas located in deep waters. In such systems, it is necessary for petroleum production wellhead pumping to be provided since these wells do not have sufficient pressure to overcome the water depth and flow up to the platform.

BACKGROUND OF THE INVENTION

In the case of deep-water production, one of the factors which most affects the flow of petroleum is the hydrostatic pressure which is due to the level difference existing between the wellhead and the production platform. The hydrostatic pressure, depending upon the situation, may represent up to more than 90% of the pressure drop between the wellhead and the platform, and therefore it is necessary for the petroleum to be pumped.

Many proposals have been presented for the purpose of defining the method for the flow of such petroleum, with perhaps the simplest method being subsea separation of oil and gas, and their single-phase flow up to the nearest platform. This separation system has the characteristics required for deep-water installation and a motor-pump to allow the oil to flow, thereby overcoming the high pressure (hydrostatic pressure drop) characteristic of this type of application.

The conventional production systems of oil fields of natural flowing usually include wells, individual flowing lines, manifolds, additional lines, and, eventually, risers in case of offshore installation. The fluids produced, usually in the form of a multiphase mixture of oil, gas and water, pass through all of the components of the production system, up to a separation vessel installed at the gathering station (on-shore) or at the production platform (off-shore).

The individual well production is a direct function of the pressure drops from the reservoir rock to the separator. Therefore, if the pressure at the separator is maintained high, or if the pressure drops along the piping are large, the production rates of the wells will be small. This is because the only form of energy for moving the mixture is the pressure of the reservoir itself.

The offshore production systems usually utilized in shallow waters aim at minimizing the pressure drops. This is accomplished by minimizing the lengths of the flow lines and the riser, thereby optimizing the production level of the wells. This is usually achieved by locating the production platform (with the pumping and processing systems) directly on the area of the reservoir.

For oil fields located in deep waters (above 400 m), the positioning of the platform directly on the reservoir is a difficult operation, since it requires the utilization of huge fixed structures or complex floating structures which are prohibitive from both technical and economic points standpoints.

Despite continued research work concerning the positioning of the platform directly on the reservoir, various other production alternatives have been considered. Among the most promising are those which make use of well completion with wet Christmas trees and a pumping system capable of adding energy to the fluids produced, with the purpose of transporting them to a production platform located in shallower waters or directly onshore.

The technical difficulty of this last production alternative resides in the pumping system, which must work with high pressures and flow rates of multiphase mixtures. The use of these multiphase pumps is based on the necessity of low-pressure maintenance at the wellhead to ensure an adequate production level.

SUMMARY OF THE INVENTION

The present invention has been developed to overcome the problems attendant with the previous systems as described above. According to the invention, a deep-water oil and gas production and transportation system is provided in which the separation of the multiphase mixture originating from the well is immediately provided at the output of the wet Christmas tree, thereby making fluid transportation (which according to the invention is now single-phase), towards the platform or unit gathering the oil and the gas easy.

According to the invention, a deep-water oil and gas production and transportation system is provided, including a 2-phase oil/gas vertical separator positioned on a subsea base, supported at the seabottom and coupled to the wet Christmas tree for feeding petroleum which leaves the well and passes through the Christmas tree; a gas cooler for lowering the temperature in order to further remove condensate from the gas originating from the separator; a vertical tubular scrubber utilized for purification and flow of the gas which leaves the cooler; and a motor-pump. The motor-pump includes a centrifugal pump driven by an induction electric motor, and, positioned at the platform or unit which gathers the oil and the gas; a velocity variator for the motor-pump, which is a rectifier coupled to an inverter of variable frequency and voltage, to a pressure-relief valve of simultaneous control of the gas pipeline, of the scrubber and of the gas/oil separator, and to a programmable logical controller. The interconnection between the platform and the subsea base is achieved by means of a flexible oil pipeline, a flexible gas pipeline and a hydraulic and electric bundle.

One application of the subsea separation system according to the invention is in deep-water oil fields. In this type of application it is possible to overcome the hydrostatic pressure, thereby increasing production and in reserve recovery. It is also possible to increase the distance from the well to the platform, by anchoring the platform in shallow waters.

Another application for the system of the invention is the production of smaller fields, in which the installation of a production platform is not feasible, but which can provide production directly to a relief monobuoy or a nearby platform.

DETAILED DESCRIPTION OF THE PREFERRED EMBODIMENT

Figure 1:
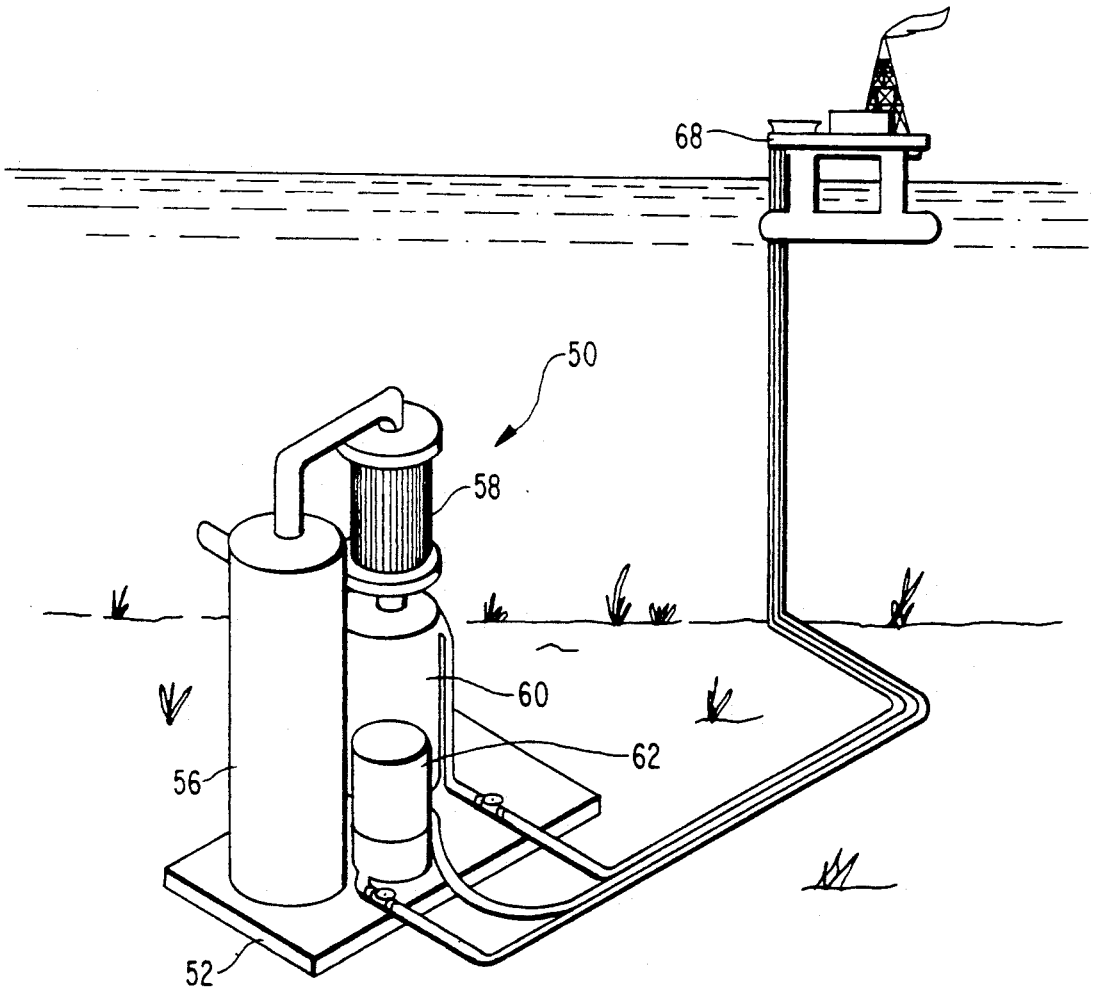
FIG. 1 is an illustrative view of the deep-water oil and gas production and transportation system of the invention.
Figure 2:
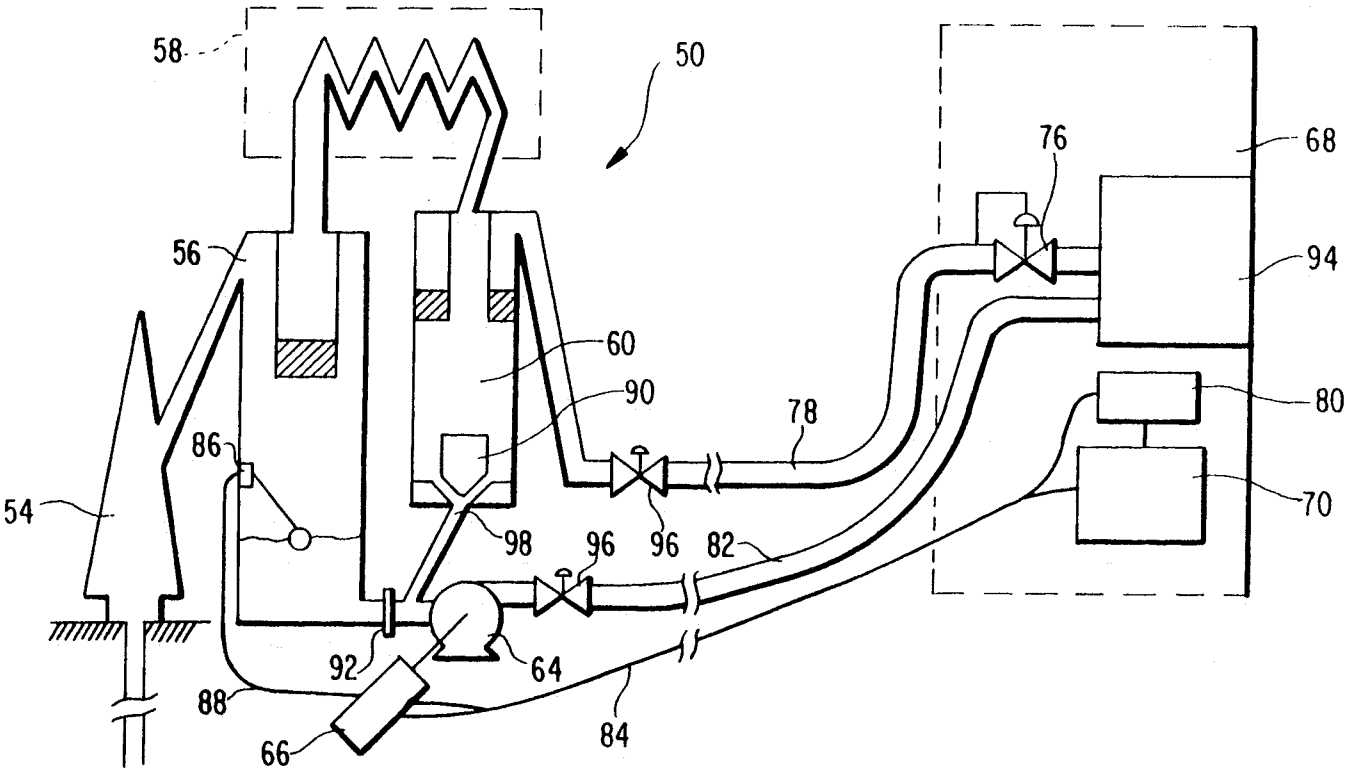
FIG. 2 is a schematic view of the system according to the invention.
Figure 3:
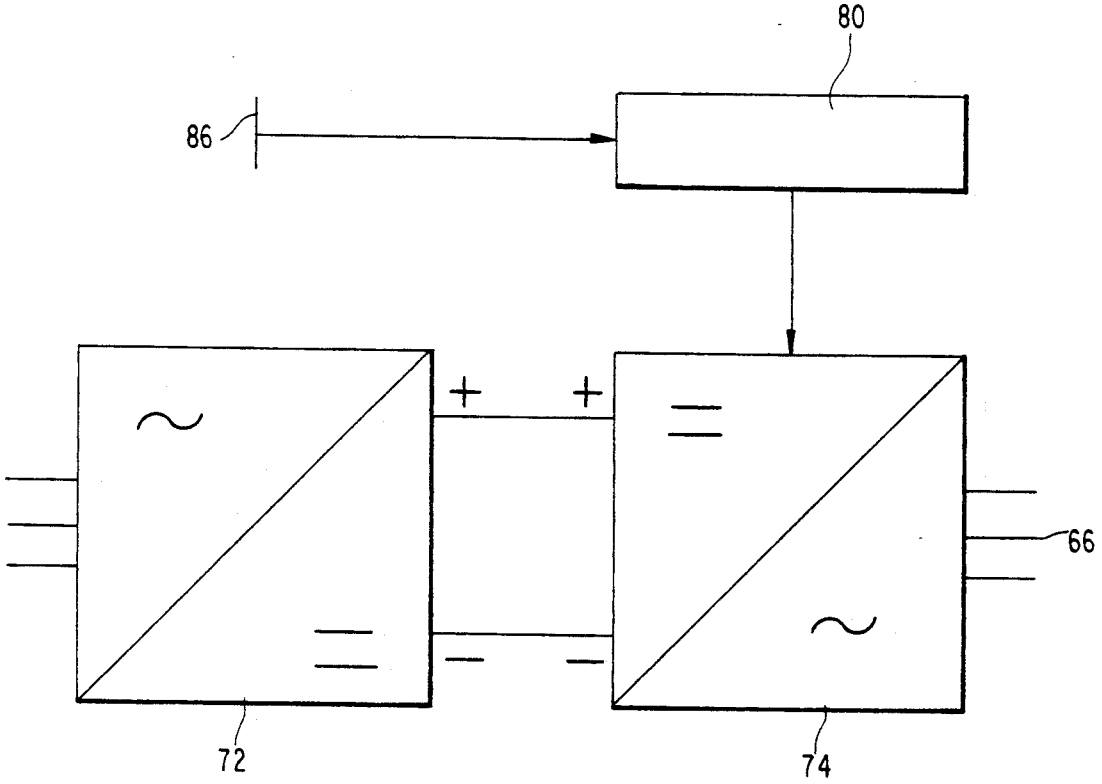
FIG. 3 is a schematic view of the velocity variator for the motor-pump set installed at the platform, utilized in the system of the invention.

As shown in FIGS. 1 and 2, the deep-water oil and gas production and transportation system 50 includes a 2-phase oil/gas vertical separator 56 positioned in a subsea base 52 which is supported by the seabottom. As shown in FIG. 2, the separator 56 is coupled to the wet Christmas tree 54. The 2-phase oil/gas vertical separator 56 serves to feed the petroleum which leaves the well and passes through the Christmas tree 54. The system 50 further includes a gas cooler 58 utilized to lower the temperature in order further to remove condensate from the gas originating from the separator 56, a vertical tubular scrubber 60 utilized for purification and flow of the gas which leaves the cooler 58, and a motor-pump 62. As shown in FIG. 2, the motor-pump 62 includes a centrifugal pump 64 driven by an electric induction motor 66, and, positioned on the platform 68 or unit gathering the oil and the gas is a velocity variator 70 for the motor-pump 62 which is a rectifier 72 coupled to an inverter of variable frequency a voltage source 74, a pressure-relief valve 76 for simultaneous control of the gas pipeline 78, of the scrubber 60 and of the gas/oil separator 56, and a programmable logical controller 80 (FIGS. 2 and 3). The interconnection between an oil/gas container 94 of the platform 68 and the subsea base 52 is achieved by means of the flexible oil pipeline 82, the flexible gas pipeline 78 and the hydraulic and electrical bundle 84.

FIG. 2 shows a scheme detailing the operation of the system of this invention, being described, as a simplification, a lay-away system. The petroleum which leaves the well passes through the Christmas tree 54, entering directly the separator 56, where the 2-phase separation of oil and gas is achieved. The level control of the separator 56 is achieved as follows: A level sensor 86 installed at the separator 56 sends a signal through a control cable 88 up to the platform 68. The level signal is received by the programmable logical controller (PLC) 80 which interprets the signal by comparing it with a set-point, and in accordance with the comparison sends to the velocity variator 70 a signal of the action to be taken as a function of the deviation of the variable controlled (level). The velocity variator 70 controls the rotation of the electric motor-pump 62 so as to vary the flow of the pumped oil, thereby maintaining the level at the separator 56.

The gas which leaves the separator 56 passes through a cooler 58 with the purpose of lowering its temperature for further removal of the condensate. The cooler 58 is a heat exchanger of tubular type which exchanges heat between the gas and the environment (seawater, which at this depth reaches a temperature of up to 40°).

The gas, after passing through the cooler 58, enters the scrubber 60, where its condensate is removed. At the bottom of the scrubber 60, there is a purger 90 which sends the condensate directly to the intake of the oil pump 64. In order to provide flow or drainage of the condensate to the intake of the pump 64 it is necessary that the pressure at the intake of the pump 64 be lower than that of the scrubber 60. With this purpose, a venturi is provided (using a plate of orifice 92 or a constriction in the line) between the gas/oil separator 56 and the intake of the pump 64. Thus, the condensate is drained from the scrubber 60 to the intake of the oil pump 64. mixed and pumped with the oil, since a minor addition of condensate to the oil makes its viscosity fall abruptly, and, thereafter, the gas which leaves the scrubber 60, (i.e., without condensate), directly enters the gas pipeline 78 and is provided to the platform 68.

The pressure control of the gas pipeline 78, or the scrubber 60 and of the gas/oil separator 56 is achieved simultaneously by one single valve 76 installed at the platform 68. The adjustment of the gas/oil separation pressure is achieved by means of the control valve 76, taking into consideration the pressure drop of the gas up to the platform.

As regards the gas/oil separator 56, its dimensions are dependent on the water depth, the flow rate and characteristics of the petroleum, and, the separation pressure. The minimum separation pressure is calculated as a function of gas separated volume and of the pressure differential at the gas pipeline 78, necessary for the flow of the gas. The maximum separation pressure is the highest pressure in which the separation ensure a single-phase oil flow. Once the maximum and minimum limits for the separation pressure are defined, knowing the flow rate and characteristics of the petroleum, the time of fluid permanence in the separator is calculated, that is, the volume of the separator.

Since the separator 56 must withstand high external pressure, i.e., since it is installed in deep waters, the format which best adapts itself to this condition without impairing its performance is that of a vertical cylinder. The separator 56 may or not receive a reinforcement in the form of rings or vertical bars. Inside the separator 56 is a level sensor 86 which sends an electric signal, via the electrical cable 88, from the separator level to the control at the platform 68.

The motor-pump 62, which includes a centrifugal pump 64 driven by an electric induction motor 66, is scaled, thereby preventing the external pressure to pressurize its interior.

Figure 4:
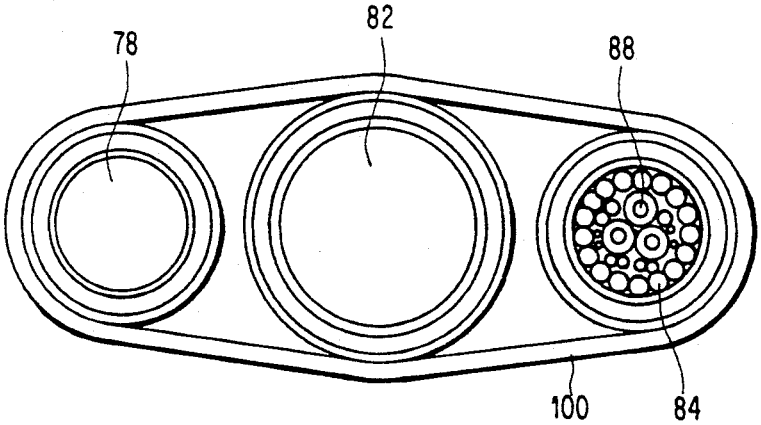
FIG. 4 is a frontal view in section of a wrapper containing therein the electrical cable, the hydraulic bundle, the gas pipeline and the oil pipeline.

The electrical cable 88 is formed by 3 power veins to feed the motor 66, plus, at least, a pair of control wires for the level sensor 86. This number can be larger, for example in case where it is desired to increase the reliability or the number of parameters to be measured. The hydraulic bundle 84 of control of the Christmas tree 54, to which are coupled the separator 56, the electrical cable 88 and the oil and gas pipelines 78 and 82, may be one single piece or formed by separate pieces (as shown in FIG. 4).

The velocity variator 70 installed at the platform 68 includes a rectifier 72 coupled to an inverter of variable frequency and voltage 74 as shown in FIG. 3. By varying the voltage and the frequency of output at the inverter 74 it is possible to vary the rotation of the motor 66 and, consequently, to adjust the curve of the pump 64 to the conditions of the separation process, which is given by the signal which comes from the level sensor 86.

The valves 96 utilized at the subsea base 52 are of the ball type, not being necessary their subsea operation due to the lay-away installation, since the valves are manually opened prior to being lowered. The control valve 76 which is located at the platform 68 at the arrival of the gas pipeline 78, can be the self-acting ball type, since its setpoint can be easily altered if required.

The scrubber 60 has a vertical cylindrical shape, and can include reinforcement depending upon its dimensions and the water depth. At the bottom of same there is a purger 90, which is buoy. When the scrubber 60 floats in the condensed gas, an orifice 98 opens, and through the orifice 98 the condensate is drained to the intake of the pump 64.

Furthermore, as it can be seen from FIG. 4, the flexible gas pipeline 78, the flexible oil pipeline 82, the electrical cable 88 and the hydraulic bundle 84 are contained inside a tight wrapper 100, working as a single piece.

Figure 5:
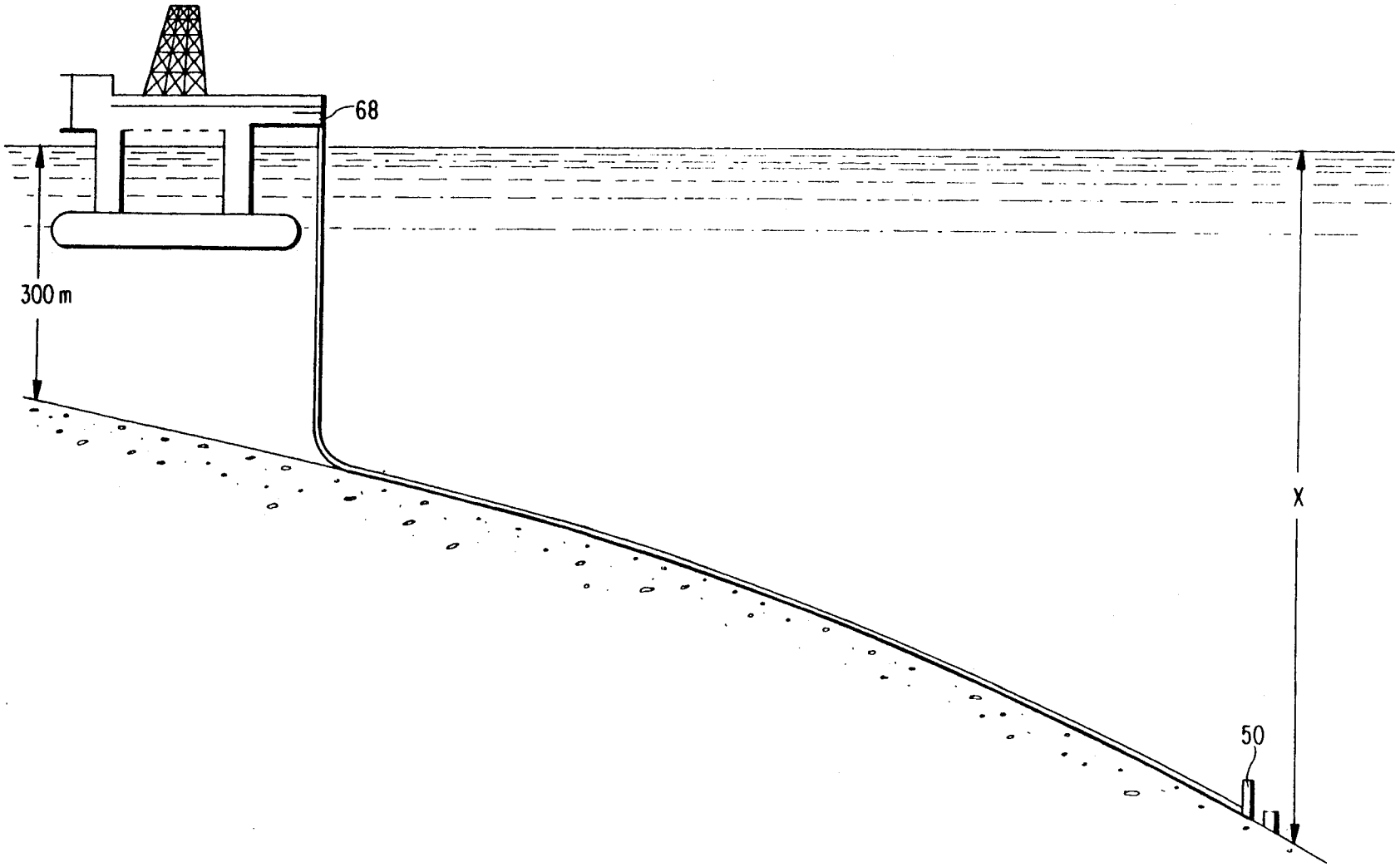
FIG. 5 is an illustrative view showing the application of the system of the invention to a deep-water oil field.

The main application of the system of this invention is in deep-water petroleum fields. In this type of application it is possible to overcome the hydrostatic pressure, thereby ensuring the flow of the oil and, consequently, the increase in production and in reserve recovery. It is also possible to increase the distance from the well to the platform, allowing the platform to be anchored in shallower waters, as shown in FIG. 5. In the example shown in FIG. 5, the distance X is 800 m.

Figure 6:
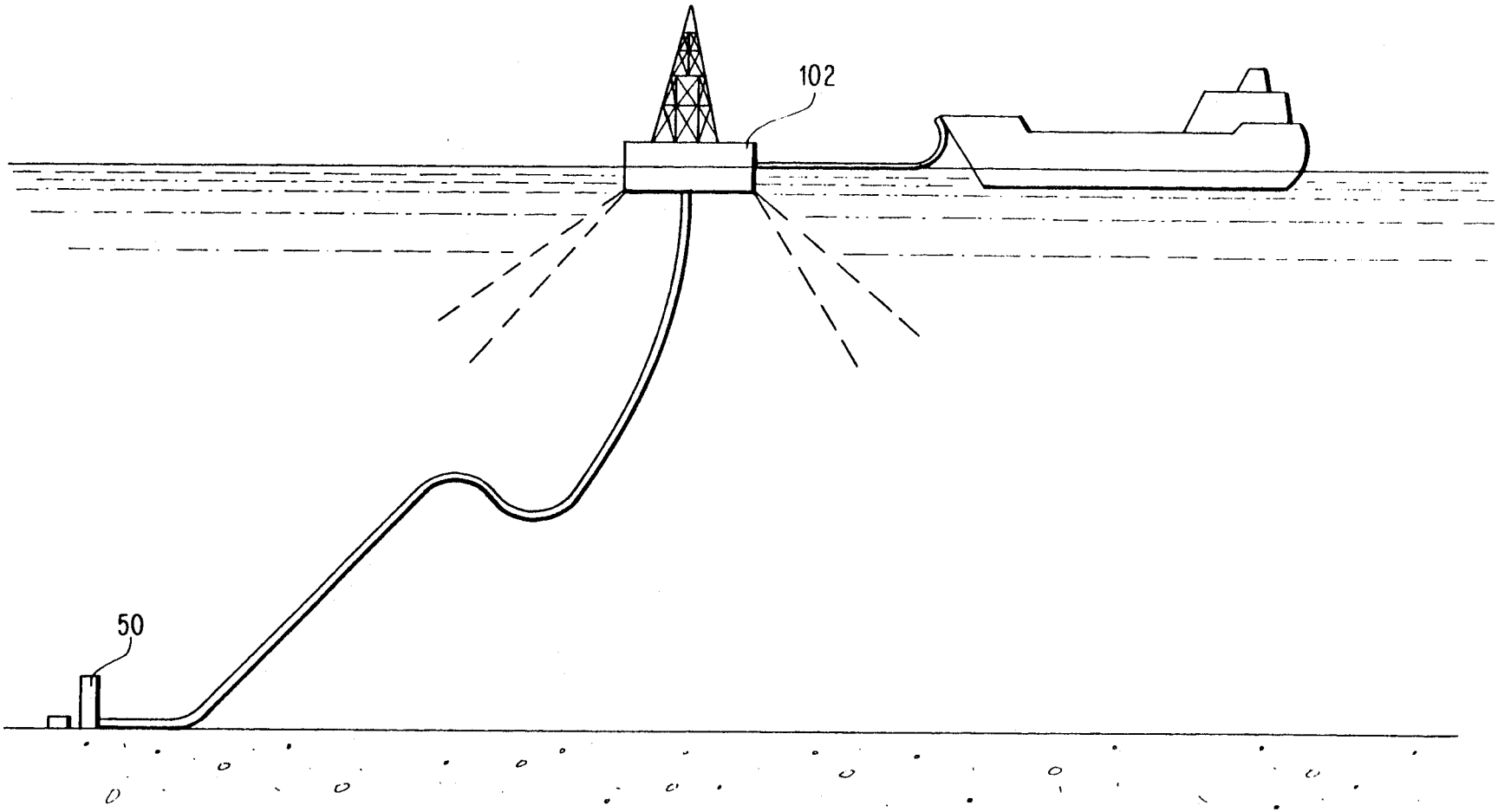
FIG. 6 is an illustrative view showing the application of the system of the invention in smaller fields.
Figure 7:
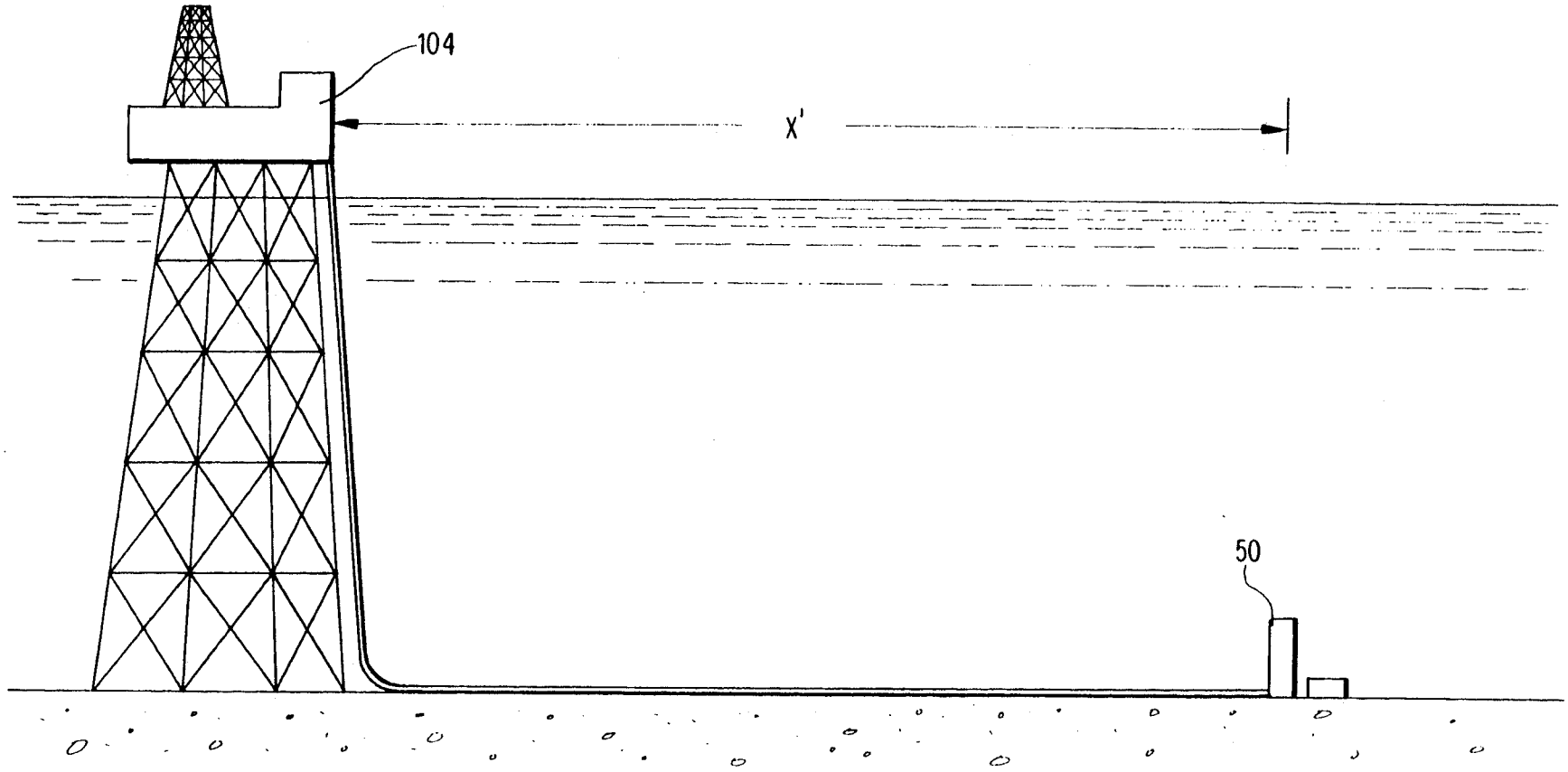
FIG. 7 is an illustrative view showing the application of the system of the invention, with direct production to a nearby platform.

Another application of the system according to the invention is the production of smaller fields in shallow waters (below 400 m) in which the installation of a production platform is not feasible. In this case, it is possible to produce directly to a relief buoy 102, shown in FIG. 6, or to a platform nearby 104 (for example X' is 20 μm), as shown in FIG. 7.

The common advantages for any application of the system of this invention are that of achieving a remote operation, with the base on a platform or onshore; that of being a safer operation, since the operator does not remain near the area of risk; that of reducing the weight of the facilities installed at the platforms; and that of a faster installation, thereby accelerating the production.

What is claimed is:

1. A deep-water oil and gas production and transportation system comprising:

a two-phase oil/gas separator (56), disposed on the sea floor, for providing two-phase separation of oil and gas provided from the sea floor;

a gas cooler (58), coupled to said separator, for lowering a temperature of gas provided form said separator, thereby removing condensate from the provided gas;

a scrubber (60), coupled to said gas cooler, for purifying gas provided from said gas cooler;

motor-pump means (62) for pumping oil provided from said scrubber;

a platform; and means for coupling gas and oil provided from said scrubber and said motor-pump means to said platform.

2. The deep-water oil and gas production and transportation system according to claim 1, wherein said cooler is a tubular-type exchanger which exchanges heat between the gas the seawater.

3. The deep-water oil and gas production and transportation system according to claim 1, further comprising a gas pipeline, and a pressure relief valve for simultaneously controlling said gas pipeline and said scrubber.

4. The deep-water oil and gas production and transportation system according to claim 1, wherein said scrubber has a vertical cylindrical shape and includes at its bottom, a purger which floats in the condensed gas, and an opening through which the condensate is drained.

5. The deep-water oil and gas production and transportation system according to claim 1, wherein said coupling means includes a flexible gas pipeline, a flexible oil pipeline, an electrical cable and a hydraulic bundle which are contained inside a tight wrapper.

6. The deep-water oil and gas production and transportation system according to claim 1, wherein said motor-pump means includes a centrifugal pump and an electric induction motor which drives said centrifugal pump.

7. The deep-water oil and gas production and transportation system according to claim 6, wherein said motor-pump means is sealed so that its interior is not pressurized by external pressure.

8. The deep-water oil and gas production and transportation system according to claim 6, further comprising a velocity variator, located at said platform, for controlling a rotation of said electric induction motor.

9. The deep-water oil and gas production and transportation system according to claim 1, further comprising computer means disposed on said platform, said computer means including a velocity variator, and a level sensor which is installed inside said separator, said level sensor operable for sending a signal through a control cable to said platform; said level signal being received by said computer means which compares the received level signal with a predetermined setpoint and which sends to said velocity variator a signal representing an action to be taken as a function of a deviation between the received level signal and the predetermined setpoint.

10. The deep-water oil and gas production and transportation system according to claim 9, wherein said velocity variator includes a rectifier coupled to an invertor of variable frequency and voltage.

* * * * *